US007326037B2

(12) United States Patent
Eslinger

(10) Patent No.: US 7,326,037 B2
(45) Date of Patent: Feb. 5, 2008

(54) CENTRIFUGAL PUMPS HAVING NON-AXISYMMETRIC FLOW PASSAGE CONTOURS, AND METHODS OF MAKING AND USING SAME

(75) Inventor: David M. Eslinger, Collinsville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 71 days.

(21) Appl. No.: 11/164,372

(22) Filed: Nov. 21, 2005

(65) Prior Publication Data

US 2007/0116560 A1 May 24, 2007

(51) Int. Cl.
*F04D 29/44* (2006.01)

(52) U.S. Cl. ..... 416/203; 415/208.3; 415/211.2

(58) Field of Classification Search ..... 416/185, 416/203; 415/208.3, 211.1, 211.2, 203, 204, 415/206, 914
See application file for complete search history.

(56) References Cited

U.S. PATENT DOCUMENTS

| | | | | |
|---|---|---|---|---|
| 4,093,401 | A | 6/1978 | Gravelle | |
| 4,317,310 | A | 3/1982 | Bollinger | |
| 4,838,758 | A | 6/1989 | Sheth | |
| 4,838,759 | A * | 6/1989 | Dunn et al. | 415/199.6 |
| 5,201,848 | A * | 4/1993 | Powers | 415/199.1 |
| 5,320,489 | A | 6/1994 | McKenna | |
| 5,417,547 | A | 5/1995 | Harada | |
| 5,605,444 | A | 2/1997 | Paton et al. | |
| 5,730,580 | A | 3/1998 | Japikse | |
| 5,927,939 | A | 7/1999 | Harada et al. | |
| 5,947,680 | A | 9/1999 | Harada et al. | |
| 6,338,610 | B1 | 1/2002 | Harada et al. | |
| 6,406,277 | B1 | 6/2002 | Shafer et al. | |
| 6,425,735 | B1 * | 7/2002 | Sheth | 415/134 |
| 6,595,746 | B1 | 7/2003 | Goto et al. | |
| 6,695,579 | B2 | 2/2004 | Meng | |
| 6,923,621 | B2 | 8/2005 | Sato | |
| 2003/0235497 | A1 * | 12/2003 | Meng | 415/208.3 |

FOREIGN PATENT DOCUMENTS

| | | |
|---|---|---|
| GB | 2053368 | 2/1981 |
| JP | 55142997 | 11/1980 |
| JP | 2004027893 | 1/2004 |
| JP | 2004027893 A * | 1/2004 |
| WO | 9002265 | 3/1990 |

OTHER PUBLICATIONS

Japikse, David; Platt, Michael J.; Concepts NREC, Optimization in Component Design and Redesign, symposium, Mar. 7-11, 2004, pp. 1-14, The 10th International Symposium on Transport Phenomena and Dynamics of Rotating Machinery, Honolulu, Hawaii.

(Continued)

*Primary Examiner*—Richard A. Edgar
(74) *Attorney, Agent, or Firm*—Jeffrey L. Wendt; Kevin Brayton McGoff; Bryan P. Galloway

(57) ABSTRACT

Centrifugal pumps and methods of making and using them are disclosed. One inventive pump includes a plurality of flow passages, at least one pump component having one or more non-axisymmetric flow passage contours defined at least in part by non-equal blade or vane heights.

20 Claims, 4 Drawing Sheets

OTHER PUBLICATIONS

Nagel, Marc G.; Baier, Ralf-D, Experimentally Verified Numerical Optimization of a Three-Dimensional Parametrized Turbine Vane with Nonaxisymmetric End Walls, journal, Apr. 2005, pp. 380-387, vol. 127, Journal of Turbomachinery, ASME, Atlanta, Georgia.

* cited by examiner

CENTRIFUGAL PUMPS HAVING NON-AXISYMMETRIC FLOW PASSAGE CONTOURS, AND METHODS OF MAKING AND USING SAME

BACKGROUND OF THE INVENTION

1. Field of Invention

The present invention relates generally to the field of fluid transfer, and more particularly to pump stages having non-axisymmetric passage contours, pump apparatus and methods of using same.

2. Related Art

Centrifugal pump stages of electrical submergible pumps (ESP) and other centrifugal pumps experience hydraulic losses due to so-called secondary flow patterns that develop within the stage. One example of a secondary flow is the development of vortices near boundaries of flow passages. Common causes of vortices and other secondary flows are Coriolis forces in impellers, and flow passage and blade curvature in impellers and diffusers. The secondary flow is commonly lower velocity than the core or primary flow, and often collects at the suction/hub corner in diffusers and at the pressure/shroud corner in impellers. Secondary flows are undesirable as they result in inefficient pump operation, surging, and in extreme cases, pump failure.

Flow passages in known diffusers are formed by hub and shroud blade contours that are surfaces of revolution about the stage axis. This makes the blade heights on the suction side and on the pressure side equal, or axisymmetric. Axisymmetric contours are the result of presently used stage analysis and design techniques and more importantly, current manufacturing techniques for making the corebox tooling.

There is a need in the fluid transfer art for pump stage designs that reduce the effects of secondary flow.

SUMMARY OF THE INVENTION

In accordance with the present invention, pump stages, pumps incorporating same, and methods of making and using same are described that reduce or overcome the described problems. A general feature of the invention is a pump component having one or more non-axisymmetric flow passage contours created by non-equal height blades or vanes. The result should be a flow pattern that is more uniform with less efficiency loss through the passage. Manufacture of the corebox hub and/or shroud contour may be accomplished using electronic discharge machining (EDM) techniques, such as plunge EDM, wire EDM, and the like.

A first aspect of the invention are centrifugal pumps comprising a plurality of flow passages, at least one component having one or more non-axisymmetric flow passage contours defined at least in part by non-equal height blades or vanes. The height is measured from a surface where the blade or vane has its root. When the at least one pump component is a diffuser, the flow passages are diffuser flow passages, which are at least in part formed by hub and shroud contours neither of which is a surface of revolution. The suction side of the blade may have a reduced blade height, while the pressure side blade height may be increased. This has the effect of increasing the velocity of the secondary flow that tends to collect at the suction blade surface and of reducing the velocity of the jet flow that tends to form at the pressure side of the diffuser blade. When the at least one pump component is an impeller, the one or more non-axisymmetric flow passages are formed between impeller vanes. Centrifugal pumps of the invention include those pumps wherein both impellers and diffusers have at least one non-axisymmetric flow passage, and embodiments wherein all of the flow passages in the pump are non-axisymmetric. The centrifugal pumps of the invention may comprise a driver, which may be a motor, turbine, diesel or non-diesel internal combustion engine, generator, and the like, in some cases combined with a protector, seal chamber, thrust chamber, gear box and the like; a driver shaft turned by the driver; and at least one pump stage comprising the at least one component having one or more non-axisymmetric flow passage contours, and a pump shaft.

The driver shaft may be one and the same as the pump shaft in certain embodiments, and in certain other embodiments the pump shaft may be mechanically coupled to and driven by the driver shaft. In other embodiments, the driver shaft and the pump shaft may be distinct and not be coupled mechanically, such as in magnetic couplings wherein the driver shaft drives a magnetic coupling comprising magnets on the driver shaft which interact with magnets in a protector, in which case the protector shaft mechanically connects to and drives the pump shaft.

Centrifugal pumps of the invention include those wherein all pump stages are identical, and have identical performance characteristics, and embodiments wherein at least two pump stages comprise a first set of pump stages each having a first defined set of performance characteristics, and a second set of pump stages each having a second defined set of performance characteristics. Apparatus of the invention include those wherein the performance characteristics are selected from head flow characteristics, brake horsepower characteristics, operating range, thrust characteristics, efficiency, net positive suction head (NPSH), and two or more thereof.

The inventive centrifugal pumps that have at least two different performance pump stages may further have a stage mixing ratio ranging from about 1:99 to about 99:1. The stage mixing ratio may in some embodiments range from about 1:9 to about 9:1. In certain other embodiments the stage mixing ratio may range from about 3:7 to about 7:3, and in other embodiments the stage mixing ratio may be 1:1.

Certain embodiments of the apparatus of the invention, such as those suitable for use downhole, may include a motor protector, which may or may not be integral with the motor, and may include integral instrumentation adapted to measure one or more downhole parameters, and means for surface communication to apparatus of the invention, for example through use of one or more communication links, including but not limited to hard wire, optical fiber, radio, or microwave transmission.

Another aspect of the invention are methods of making a centrifugal pump, one method of the invention comprising:

(a) selecting a pump component to have at least one non-axisymmetric flow passage contour;

(b) forming (for example, by laser cutting, electronic discharge machining, or other methods) the at least one non-axisymmetric flow passage contour defined at least in part by non-equal height blades or vanes; and (c) combining the pump component with other pump components to form the centrifugal pump.

Methods of the invention include those wherein the selecting a pump component to have at least one non-axisymmetric flow passage contour comprises selecting from among diffusers, impellers, inducers and shrouds. Other methods of this aspect of the invention include those wherein the forming of the non-axisymmetric flow passage contours is by milling, drilling, turning, tapping, casting, polishing, laser cutting, electronic discharge machining, and combinations thereof. Electronic discharge machining methods may be selected from wire EDM, plunge EDM, current small hole EDM, sinker EDM and combinations thereof.

Yet another aspect of the invention are methods of pumping fluids, one method comprising:

(a) determining a pumping requirement for transferring a fluid;

(b) selecting a centrifugal pump to meet the pumping requirement, the pump having at least one pump component having at least one non-axisymmetric flow passage defined at least in part by non-equal height blades or vanes; and (c) pumping the fluid using the pump to meet the pumping requirement.

Apparatus and methods of the invention will become more apparent upon review of the brief description of the drawings, the detailed description of the invention, and the claims that follow.

BRIEF DESCRIPTION OF THE DRAWINGS

The manner in which the objectives of the invention and other desirable characteristics can be obtained is explained in the following description and attached drawings in which.

Figure 1:
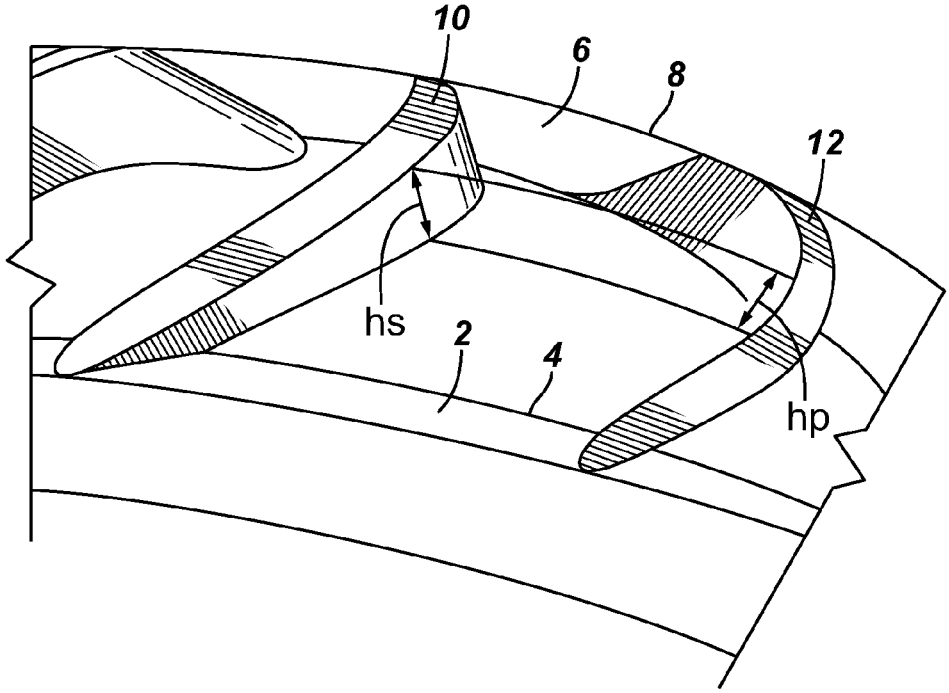
FIG. 1 (Prior Art)
FIG. 1 is a schematic perspective view of a prior art diffuser design having an axisymmetric flow passage contour.

It is to be noted, however, that the appended drawings are not to scale and illustrate only typical embodiments of this invention, and are therefore not to be considered limiting of its scope, for the invention may admit to other equally effective embodiments.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

All phrases, derivations, collocations and multiword expressions used herein, in particular in the claims that follow, are expressly not limited to nouns and verbs. It is apparent that meanings are not just expressed by nouns and verbs or single words. Languages use a variety of ways to express content. The existence of inventive concepts and the ways in which these are expressed varies in language-cultures. For example, many lexicalized compounds in Germanic languages are often expressed as adjective-noun combinations, noun-preposition-noun combinations or derivations in Romantic languages. The possibility to include phrases, derivations and collocations in the claims is essential for high-quality patents, making it possible to reduce expressions to their conceptual content, and all possible conceptual combinations of words that are compatible with such content (either within a language or across languages) are intended to be included in the used phrases.

The invention describes centrifugal pumps comprising a plurality of flow passages, at least one component having one or more non-axisymmetric flow passage contours defined at least in part by non-equal height blades or vanes, and methods of making and using same for pumping fluids, for example, to and from wellbores, although the invention is applicable to pumps designed for any intended use, including, but not limited to, so-called surface fluid transfer operations. A "welibore" may be any type of well, including, but not limited to, a producing well, a non-producing well, an experimental well, an exploratory well, and the like. Wellbores may be vertical, horizontal, some angle between vertical and horizontal, and combinations thereof, for example a vertical well with a non-vertical component. As discussed, centrifugal pump stages of electrical submergible pumps (ESP) and other centrifugal pumps experience hydraulic losses due to so-called secondary flow patterns that develop within the stage. One example of a secondary flow is the development of vortices near boundaries of flow passages. Common causes of vortices and other secondary flows are Coriolis forces in impellers, and flow passage and blade curvature in impellers and diffusers. The secondary flow is commonly lower velocity than the core or primary flow, and often collects at the suction/hub corner in diffusers and at the pressure/shroud corner in impellers. Secondary flows are undesirable as they result in inefficient pump operation, surging, and in extreme cases, pump failure. Flow passages in known diffusers are formed by hub and shroud blade contours that are surfaces of revolution about the stage axis. This makes the blade heights on the suction side and on the pressure side equal, or axisymmetric. Axisymmetric contours are the result of presently used stage analysis and design techniques and more importantly, current manufacturing techniques for making the corebox tooling.

Given that there is considerable investment in existing equipment, it would be an advance in the art if centrifugal pumps could be designed to reduce or eliminate problems due to secondary flows.

FIG. 1 is a schematic perspective view of a prior art diffuser design having an axisymmetric flow passage contour. The hub 2 and shroud 6 contours, 4 and 8 respectively, are surfaces of revolution about the stage axis, which is parallel to the Y-axis. This makes blades 10 and 12 have blade height on the suction side, "hs", and on the pressure side, "hp", equal, and thus the flow passage between blades 10 and 12 is termed axisymmetric. Axisymmetric contours are the result of current stage analysis techniques and more importantly, current manufacturing techniques for making the corebox tooling.

Figure 2:
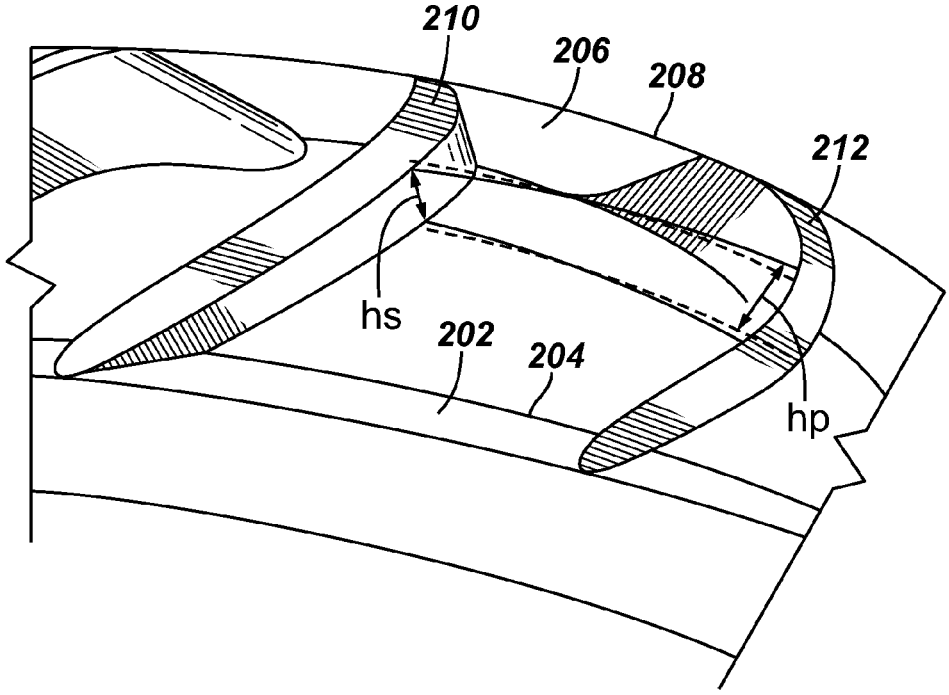
FIG. 2 is a schematic perspective view of a diffuser design of the invention having a non-axisymmetric flow passage contour.

FIG. 2 is a schematic perspective view of a diffuser design of the invention having a non-axisymmetric flow passage contour. The hub 202 and shroud 206 contours, 204 and 208 respectively, are not surfaces of revolution about the stage axis. This makes blades 210 and 212 have blade height on the suction side, "hs", and on the pressure side, "hp", non-equal, and thus the flow passage between blades 210 and 212 is termed non-axisymmetric. Non-axisymmetric contours are the result of the suction side of blade 210 having blade height, hs, that is less than the blade height compared with the axisymmetric version, while the pressure side blade height, hp, of blade 212 is greater than the blade height compared with the axisymmetric version. The blade heights in the axisymmetric version are illustrated by the dashed lines. This has the effect of increasing the velocity of the secondary flow that tends to collect at the suction side blade surface of blade 210 and of reducing the velocity of the jet flow that tends to form at the pressure side of the diffuser blade 212. The result should be a flow pattern that is more uniform with less efficiency loss through the passage.

Manufacture of the corebox hub and/or shroud contour may be accomplished using one or more methods selected from milling, drilling, turning, tapping, casting, polishing, laser cutting, electronic discharge machining (EDM), and combinations thereof. Certain contours may be formed by wire EDM, plunge EDM, current small hole EDM, sinker EDM, and combinations thereof. Plunge EDM machines are available from manufacturers such as Easco-Sparcatron Corporation, Holly, Mich. (under the trade designation "JM320C"); Hansveldt (under the trade designation "CS-1"); Sodick, Schaumburg, Ill. (under the trade designations KICN and "MOLDMAKER"). Wire EDM machines are available from Sodick (under the trade designations AQ325L, 300L, and AQ750L), and from Fanuc (under the trade designations MODEL OC and MODEL OIA). Technical information and contract machining using EDM techniques are available from numerous suppliers, such as Norman Noble, Inc., Highland Heights, Ohio, and their web site, www.nnoble.com; and AMT, Inc., Poway, Calif., and their web site at www.amtinc.com.

Figure 3:
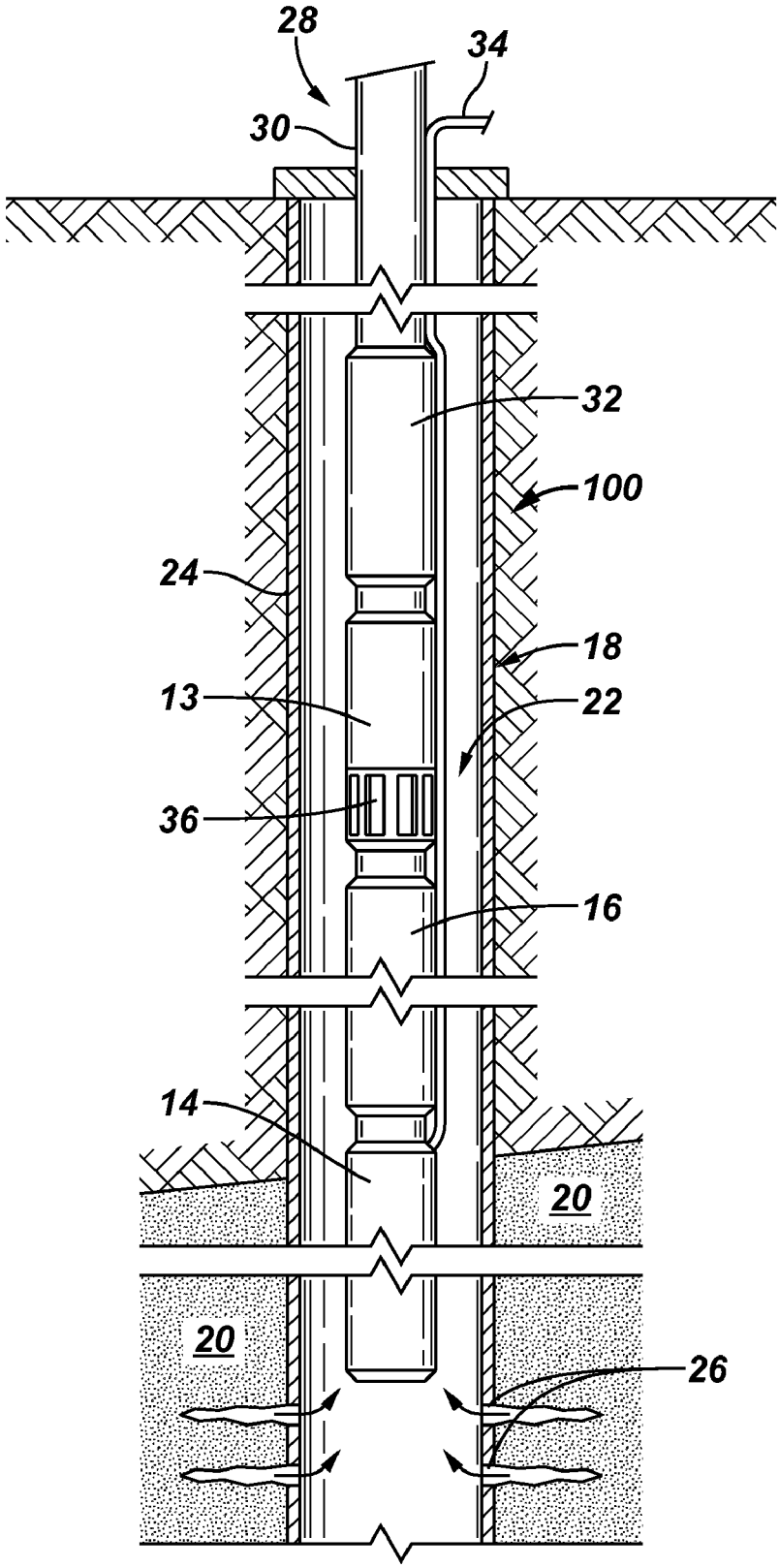
FIG. 3 is a front elevation view of an exemplary electrical submersible pump disposed within a wellbore.
Figure 4:
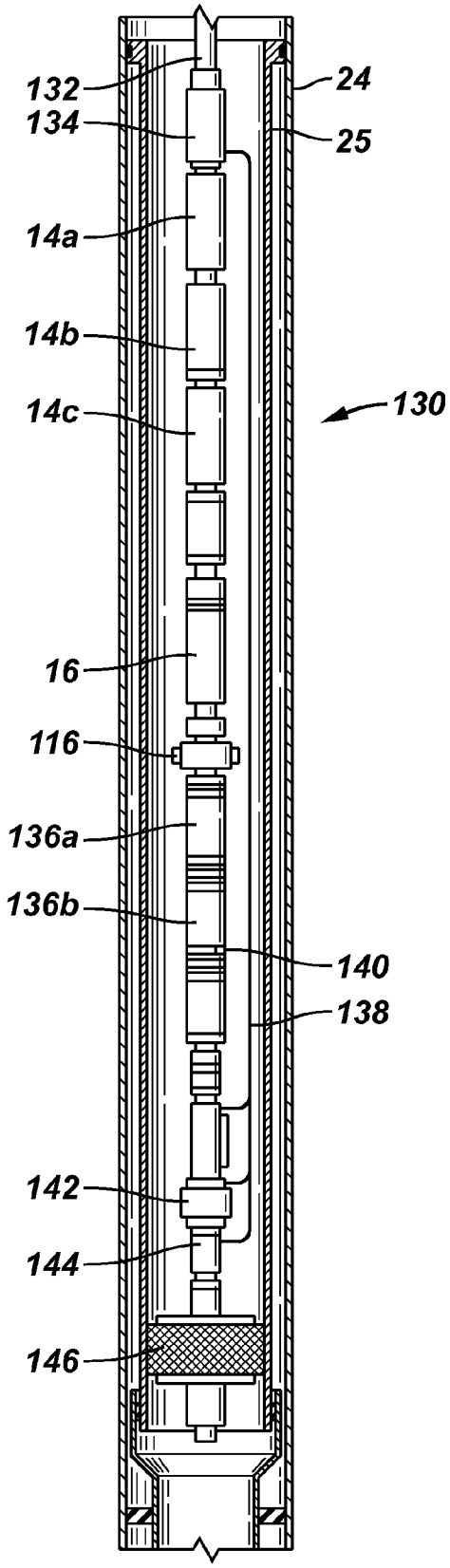
FIG. 4 is a schematic side elevation view, partially in cross section, of a vertical pumping system incorporating the diffuser design of FIG. 2.
Figure 5:
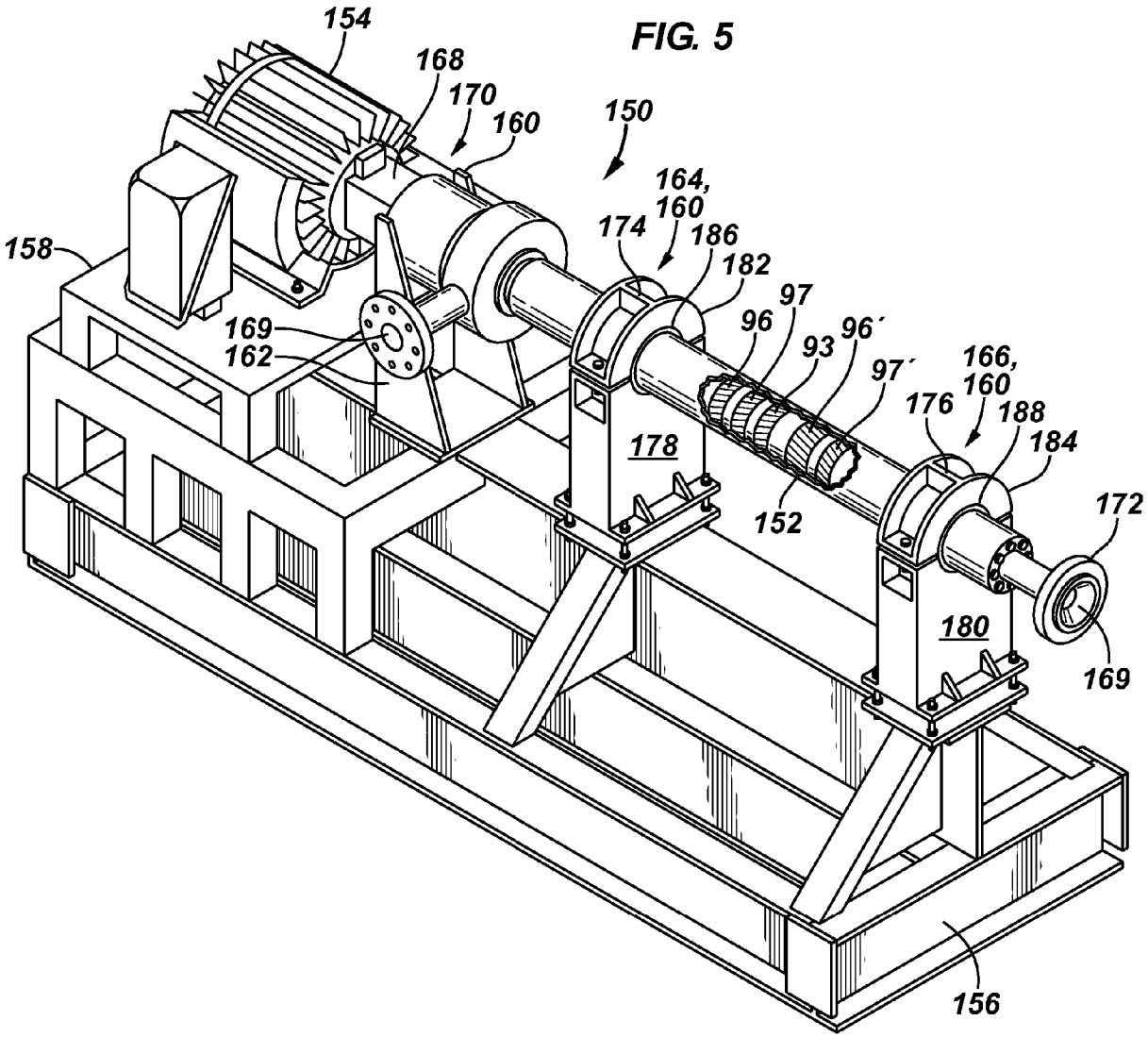
FIG. 5 is a schematic side elevation view, partially in cross section, of a horizontal pumping system incorporating the diffuser design of FIG. 2.

The principles of the present invention may be used in any centrifugal pump or pumping system. FIGS. 3, 4, and 5 illustrate three non-limiting centrifugal pumps utilizing non-axisymmetric flow passage contours in at least one pump component. Referring generally to FIG. 3, a submersible pumping system 100 is illustrated. Pumping system 100 may comprise a variety of components depending on the particular application or environment in which it is used. Typically, system 100 has at least a submersible pump 13, a motor 14 and a protector 16. Motor 14 may comprise any electric motor or other motor that requires volume compensation based on, for instance, the thermal expansion and/or contraction of internal fluid. The submersible pump 13 may be of a variety of types, for example a centrifugal pump, an axial flow pump, or a mixture thereof, although the principles of the invention are pertinent only to the centrifugal pump portion of the pump. System 100 may also comprise a gearbox, thrust chamber, seal chamber, and the like, as is known in the art.

In the illustrated example, pumping system 100 is designed for deployment in a well 18 within a geological formation 20 containing desirable production fluids, such as petroleum. In a typical application, a wellbore 22 is drilled and lined with a wellbore casing 24. Wellbore casing 24 typically has a plurality of openings 26, for example perforations, through which production fluids may flow into wellbore 22.

Pumping system 100 is deployed in wellbore 22 by a deployment system 28 that may have a variety of forms and configurations. For example, deployment system 28 may comprise tubing 30 connected to pump 13 by a connector 32. Power is provided to submersible motor 14 via a power cable 34. Motor 14, in turn, powers centrifugal pump 13, which draws production fluid in through a pump intake 36 and pumps the production fluid to the surface via tubing 30.

FIG. 4 illustrates another alternative electrical submersible pump configuration 130 in accordance with the invention. Centrifugal pumps are designed to certain specifications so problems may appear when the equipment is mis-applied or misoperated. There are limitations regarding pressure, temperature, motor horsepower, and the like, which may be interrelated. How close to the envelope the pump is operated may ultimately effect system longevity. Very often the pump cost is a fraction of the workover costs. In an effort to mitigate the life cycle costs, alternative methods of deployment have been investigated. This has included, over the past 20 years, an ESP deployed on cable, an ESP deployed on coiled tubing with power cable strapped to the outside of the coiled tubing (the tubing acts as the producing medium), and more recently a system known under the trade designation REDACoil™ as illustrated in FIG. 4 with a power cable 132 deployed internally in coiled tubing 25. In embodiment 130 illustrated in FIG. 4, three "on top" motors 14*a*, 14*b*, and 14*c* drive three pump stages 136*a*, 136*b*, and 138, all pump stages enclosed in a housing 141. Pump stages 136*a*, 136*b* and 138 may be identical in number of pump stages and performance characteristics, or pump stage 138 may have different performance characteristics, in accordance with the invention. A separate protector 16 is provided, as well as an optional pressure/temperature gauge 140. Also provided in this embodiment is a sub-surface safety valve (SSSV) 142 and a chemical injection mandrel 144. A lower connector 134 is employed, which may be hydraulically releasable with power cable 135, and may include a control line and instrument wire feedthrough. A control line set packer, 146, completes this embodiment. The technology of bottom intake ESPs (with motor on the top) has been established over a period of years. It is important to securely install pump stages, motors, and protector within coiled tubing 25, enabling quicker installation and retrieval times plus cable protection and the opportunity to strip in and out of a live well. This may be accomplished using a deployment cable 132, which may be a cable known under the trade designation REDACoil™, including a power cable and flat pack with instrument wire and one or more, typically three hydraulic control lines, one each for operating the lower connector release, SSSV, and packer setting/chemical injection.

In a variety of applications, it is advantageous to utilize a surface pump, such as a horizontal pumping system ("HPS"). Referring generally to FIG. 5, an exemplary horizontal pumping system ("HPS") 150 that may employ one or more non-axisymmetric flow passage contours is illustrated according to the present invention in perspective, with parts broken away. The HPS 150 includes a pump 152, a motor 154 drivingly coupled to pump 152, and a horizontal skid 156 for supporting pump 152 and motor 154. As with submersible pumps of the invention, the principles of the invention are pertinent only when pump 152 comprises a centrifugal pump, while motor 154 may be substituted for any of a number of drivers, such as turbines, generators, and the like. However, the HPS may comprise other pumps, such as positive displacement pumps, in conjunction with the centrifugal pump, and other drivers for a given application. Pump 152 includes a first set of impellers 96 and diffusers 97 designed move fluid through pump 152 toward second stage having a same or different set of impellers 96' and diffusers 97', eventually forcing fluid out through a discharge 169, wherein the other pump conduit 169 is a pump intake. Apparatus 150 includes pump stages connected through a connector 93. As may be seen a single pump housing houses both pump stages.

As explained in assignee's U.S. Pat. No. 6,425,735, motor 154 may be fixedly coupled to horizontal skid 156 at a motor mount surface 158 of horizontal skid 156. Pump 152 may be coupled to horizontal skid 156 by a mount assembly 160. Mount assembly 160 may include a support 162 (e.g., a fixed support) and clamp assemblies 164 and 166. Support 162 extends outwardly from the motor mount surface 158 at an axial position 168 lengthwise along horizontal skid 156. Pump 152 is drivingly coupled to motor 154 through support 162.

Alternatively, support 162 may be an external conduit assembly configured for attachment to a pump conduit, such as one of two pump conduits 169 extending from pump 152. Support 162, in either the illustrated configuration or as an external conduit assembly, may axially fix pump 152 or may allow axial movement of pump 152 with respect to support 162. Pump conduits 169 are configured to receive and expel a fluid, or vice versa, as pump 152 operates. For example, pump 152 may displace water, salt water, sewage, chemicals, oil, liquid propane, or other fluids in through one of the pump conduits 169 and out of the other pump conduit 169. In addition, the temperature of the fluids may vary. For example, some applications may involve pumping hot fluids, while others may involve pumping cold fluids. In addition, the temperature may change during the pumping operation, either from the source of the fluid itself, or possibly due to the heat generated by the operation of pump 152 and/or motor 154. In addition, temperature may change dramatically due to weather change.

Pump 152 may have a fixed end 170 and a free end 172, fixed end 170 being axially fixed at support 162. Clamp assemblies 164 and 166 may be coupled to horizontal skid at axial positions 174 and 176, respectively, and preferably generally parallel with support 162. Clamp assemblies 164 and 166 have base members 178 and 180 and upper clamps 182 and 184, creating clamping conduits 186 and 188, respectively, for mounting pump 152 in clamping conduits 186 and 188.

Clamp assemblies 164 and 166 may be configured to allow axial movement of pump 152 through clamping conduits 186 and 188. This axial freedom is intended to reduce stresses and fatigue, and possible mechanical failure, due to vibrations and thermal expansion/contraction of pump 152. Furthermore, the number and geometry of clamp assemblies may vary depending on the application, size of pump 152, and other factors.

Apparatus of the invention may include many optional items. One optional feature of apparatus of the invention is one or more sensors located at the protector 16 to detect the presence of hydrocarbons (or other chemicals of interest) in the internal lubricant fluid 54. The chemical indicator may communicate its signal to the surface over a fiber optic line, wire line, wireless transmission, and the like. When a certain chemical is detected that would present a safety hazard or possibly damage motor 14 if allowed to reach the motor, the pump may be shut down long before the chemical creates a problem.

A typical use of apparatus of this invention will be in situations when it is desired to reduce secondary flows during a particular pumping operation. Production of fluid using coiled tubing or other tubing may become more difficult as a well's pressure changes at a constant depth, or if the well is drilled deeper than originally planned. In these situations, forcing available pumps to do the pumping job may not only be inefficient, but may be unsafe. Apparatus of the invention may then be employed to solve the problem, particularly if the technicians have the equipment, tools, and know-how to connect existing pump stages and install pump components having non-axisymmetric flow passage contours in accordance with the invention.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, no clauses are intended to be in the means-plus-function format allowed by 35 U.S.C. § 112, paragraph 6 unless "means for" is explicitly recited together with an associated function. "Means for" clauses are intended to cover the structures described herein as performing the recited function and not only structural equivalents, but also equivalent structures.

What is claimed is:

1. A centrifugal pump comprising a plurality of flow passages, at least one component having one or more non-axisymmetric flow passage contours defined at least in part by non-equal suction side and pressure side blade or vane heights, and wherein the suction side blade or vane height is less than the pressure side blade or vane height.

2. The centrifugal pump of claim 1 wherein the height is measured from a surface where the blade or vane has its root.

3. The centrifugal pump of claim 1 wherein the at least one component is a diffuser, and the flow passages are diffuser flow passages.

4. The centrifugal pump of claim 3 wherein the diffuser flow passages are at least in part formed by hub and shroud contours neither of which is a surface of revolution.

5. The centrifugal pump of claim 3 comprising an impeller having one or more non-axisymmetric flow passages formed between impeller vanes.

6. The centrifugal pump of claim 1 wherein the suction side blade or vane height is less than a suction side blade or vane height compared to a component having axisymmetric flow passage contours.

7. The centrifugal pump of claim 6 wherein a pressure side blade height is greater than a pressure side blade height compared to the component having axisymmetric flow passage contours.

8. The centrifugal pump of claim 1 wherein a pressure side blade or vane height is greater than a pressure side blade or vane height compared to a component having axisymmetric flow passage contours.

9. The centrifugal pump of claim 1 wherein the at least one pump component is an impeller, and the one or more non-axisymmetric flow passages are formed between impeller vanes.

10. The centrifugal pump of claim 1 wherein all of the plurality of flow passages are non-axisymmetric.

11. The centrifugal pump of claim 1 in the form of an electric submersible pump.

12. The centrifugal pump of claim 1 in the form of a horizontal pumping system.

13. A method comprising:

(a) selecting a centrifugal pump component to have at least one non-axisymmetric flow passage contour defined at least in part by non-equal suction side and pressure side blade or vane heights, wherein the suction side blade or vane height is less than the pressure side blade or vane height;

(b) forming the at least one non-axisymmetric flow passage contour; and (c) combining the centrifugal pump component with other pump components to form a centrifugal pump.

14. The method of claim 13 wherein the selecting a centrifugal pump component to have at least one non-axisymmetric flow passage contour comprises selecting from among diffusers, inducers, impellers, and shrouds.

15. The method of claim 13 wherein the forming of the non-axisymmetric flow passage contours comprises one or more methods selected from milling, drilling, turning, tapping, casting, polishing, laser cutting, electronic discharge machining, and combinations thereof.

16. The method of claim 15 wherein the electronic discharge machining is selected from wire EDM, plunge EDM, current small hole EDM, sinker EDM and combinations thereof.

17. A method comprising:

(a) determining a pumping requirement for transferring a fluid;

(b) selecting a centrifugal pump to meet the pumping requirement, the pump having at least one pump component having at least one non-axisymmetric flow passage defined at least in part by non-equal suction side and pressure side blade or vane heights, wherein the suction side blade or vane height is less than the pressure side blade or vane height; and (c) pumping the fluid using the pump to meet the pumping requirement.

18. The method of claim 17 wherein the selecting centrifugal pump to meet the pumping requirement comprises selecting a centrifugal pump having at least one pump component selected from diffusers, inducers, impellers, and shrouds having at least one non-axisymmetric flow passage defined at least in part by non-equal height blades or vanes.

19. The method of claim 17 wherein the pump component selected is a diffuser.

20. The method of claim 17 wherein the pump component selected is an impeller.

* * * * *